US009289762B2

(12) United States Patent
Belgardt et al.

(10) Patent No.: US 9,289,762 B2
(45) Date of Patent: Mar. 22, 2016

(54) METHOD FOR DOSING A LIQUID USING A PIPETTE AND A SYRINGE, AND PIPETTE FOR OPERATING A SYRINGE FOR DOSING A LIQUID

(71) Applicant: Eppendorf AG, Hamburg (DE)

(72) Inventors: Herbert Belgardt, Hamburg (DE); Peter Molitor, Hamburg (DE); Burkhardt Reichmuth, Hamburg (DE)

(73) Assignee: Eppendorf AG, Hamburg (DE)

( * ) Notice: Subject to any disclaimer, the term of this patent is extended or adjusted under 35 U.S.C. 154(b) by 107 days.

(21) Appl. No.: 13/867,800

(22) Filed: Apr. 22, 2013

(65) Prior Publication Data

US 2014/0010731 A1 Jan. 9, 2014

Related U.S. Application Data

(60) Provisional application No. 61/636,977, filed on Apr. 23, 2012.

(51) Int. Cl.
*B01L 3/02* (2006.01)

(52) U.S. Cl.
CPC ..... *B01L 3/0237* (2013.01); *B01L 3/0234* (2013.01); *B01L 2200/023* (2013.01); *B01L 2200/143* (2013.01); *B01L 2300/02* (2013.01); *B01L 2300/027* (2013.01)

(58) Field of Classification Search
CPC ..... B01L 3/0234
USPC ..... 422/515; 73/864.18
See application file for complete search history.

(56) References Cited

U.S. PATENT DOCUMENTS

| | | | |
|---|---|---|---|
| 4,406,170 | A | 9/1983 | Kühn |
| 5,591,408 | A | 1/1997 | Belgardt et al. |
| 5,620,660 | A | 4/1997 | Belgardt et al. |
| 5,620,661 | A | 4/1997 | Schürbrock |
| 6,254,832 | B1 | 7/2001 | Rainin et al. |
| 7,731,908 | B2 | 6/2010 | Lenz |

FOREIGN PATENT DOCUMENTS

| | | |
|---|---|---|
| DE | 2926691 | 6/1981 |
| DE | 4437716 | 7/1996 |
| EP | 0656229 | 6/1995 |
| EP | 0657216 | 6/1995 |
| EP | 0679439 | 11/1995 |
| EP | 1724020 | 11/2006 |

*Primary Examiner* — Jan Ludlow
(74) *Attorney, Agent, or Firm* — Vidas Arrett & Steinkraus

(57) ABSTRACT

A method for dosing a liquid using a pipette with adjustable dosing step size and an indicating equipment and a syringe that can be operated using the pipette. The syringe is detachably connected to the pipette. The dosing step size is set, or the dosing step size set before is maintained. The dosing volume adjusted via the dosing step size is indicated. Liquid is aspirated into the syringe. Dosing steps are performed, counted and the number of performed dosing steps and/or the number of dosing steps still possible without refilling the syringe is determined and indicated. After performing the maximum number of dosing steps possible without refilling the syringe, either the syringe is detached, or the steps are performed again. The overall performed number of dosing steps with the set dosing step size is counted, and/or the number of dosing steps still possible without refilling is determined and indicated.

7 Claims, 15 Drawing Sheets

Fig. 4
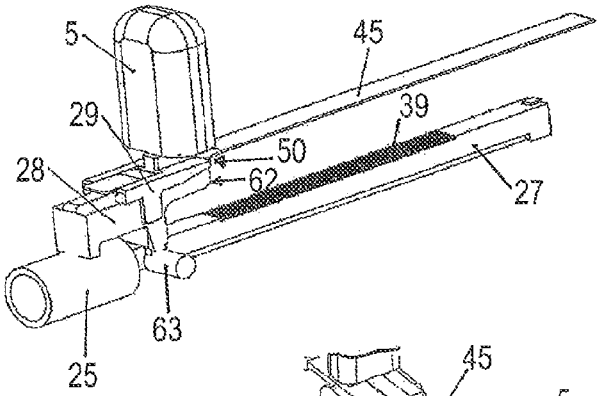
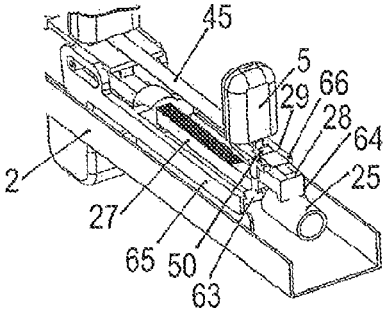
Fig. 5

Altering of the volume dial during dispensing

Resetting of the volume dial during dispensing

Fig. 21

Partial filling

Counter is only active in the positions:
position delivered residual amount
position drawn up until stop
Counting begins only after completely executed reverse stroke steps 888 / 8.8.8 ml — Insertion of the battery: short flashing of all symbols

Combitip not inserted:

steps 5 / 500 µl — Combitip inserted: (example 2,5 ml Cbt) dial position 10; arrow draw-up; steps 5; 500µl steps 5 / 500 µl — Liquid not picked up completely: dial position 10; arrow delivery; steps 5; 500µl whole display begins to blink when the lowermost position III is leaved. Steps 5 is only displayed again after actuation of the upper end switch.

steps 0 / 500 µl — reverse stroke executed completely: dial position 10; arrow delivery; steps 0; 500µl Blinking of the whole display is ended after execution of the fixed reverse stroke !!!

steps 1 / 500 µl — Dispensing: dial position 10; arrow delivery; steps 1; 500µl steps 5 / 500 µl — Dispensing: dial position 10; arrow delivery; arrow draw-up; steps 5; 500µl; Hint: counting continued while residual stroke blocker starts steps 5 / 500 µl — Residual amount delivered dial position 10; arrow delivery; 500µl; complete display blinks

Combitip ejected: dial position 10; display expires immediately after ejection When the draw-up lever is moved up to the upper stop and there is no actuation of the actuation button, but the draw-up lever is moved into the lower position by hand, this is considered as a partial filling and is processed like in the upper flow chart.

Reverse stroke upon partial filling:

1. dial position 0,5 → 8 actuations → step counter 0
2. dial position 1,0 → 4 actuations → step counter 0
3. dial position 1,5 → 3 actuations → step counter 0
4. dial position 2,0 → 2 actuations → step counter 0
5. dial position 2,5 → 2 actuations → step counter 0
6. dial position 3,0 → 2 actuations → step counter 0
7. dial position 3,5 → 2 actuations → step counter 0
8. dial position 4,0 → 1 actuation → step counter 0
9. dial position 4,5 → 1 actuation → step counter 0
10. dial position 5,0 → 1 actuation → step counter 0
11. dial position 5,5 → 1 actuation → step counter 0
12. dial position 6,0 → 1 actuation → step counter 0
13. dial position 6,5 → 1 actuation → step counter 0
14. dial position 7,0 → 1 actuation → step counter 0
15. dial position 7,5 → 1 actuation → step counter 0
16. dial position 8,0 → 1 actuation → step counter 0
17. dial position 8,5 → 1 actuation → step counter 0
18. dial position 9,0 → 1 actuation → step counter 0
19. dial position 9,5 → 1 actuation → step counter 0
20. dial position 10 → 1 actuation → step counter 0

Fig. 22

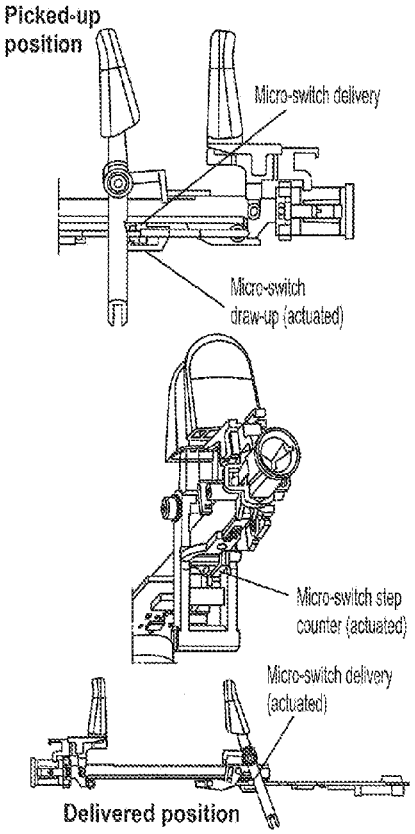

METHOD FOR DOSING A LIQUID USING A PIPETTE AND A SYRINGE, AND PIPETTE FOR OPERATING A SYRINGE FOR DOSING A LIQUID

CROSS-REFERENCE TO RELATED APPLICATIONS

This application claim priority to provisional patent application No. 61/636,977 filed Apr. 23, 2012, the entire contents of which are hereby incorporated by reference.

STATEMENT REGARDING FEDERALLY SPONSORED RESEARCH

Not applicable

BACKGROUND OF THE INVENTION

The present invention relates to a method for dosing a liquid using a pipette and a syringe, and to a pipette for operating a syringe for dosing a liquid.

The pipettes for operating a syringe discussed here serve for discharging liquid taken up into the syringe in several steps. They are also called dispensers or repeater pipettes. At the lower end of a bar-shaped housing, these pipettes have a fixture for a flange of a cylinder of the syringe, and in the housing a displaceable fixture body with a piston fixture for the upper end portion of a piston rod of a piston of the syringe. The syringe can be inserted with the flange and the end portion of the piston rod through axially oriented openings of the fixtures. The flange and the end portion are held in the fixtures by means for detachable holding, which are for instance configured as spring-tensioned gripping levers. Further, the pipette has means for relocating the fixture body, which permit to draw the piston partially out of the cylinder in order to aspirate liquid into the syringe, and to push it stepwise into the cylinder for stepwise discharge of liquid.

The documents DE 2926691 C2 and U.S. Pat. No. 4,406,170 A, the entire contents of which are incorporated herein by reference, describe means for relocating the fixture body in the housing. These comprise a draw-up lever, connected to the fixture body and projecting out of the housing through a straight slit, for aspirating liquid into the syringe by moving the fixture body away from the fixture. They further comprise a tooth bar pawl device for stepwise piston forward movement by a reciprocating dosing lever. A pivotal pawl is bearing mounted on the dosing lever. The tooth bar is connected to the fixture body and arranged in the pivot region of the pawl. An adjustably movable covering more or less covers up the tooth row on the tooth bar, in order to limit the engagement of the pawl into the tooth bar when the dosing lever is swung. Further, the tooth bar is designed with a contour, by which the covering can be moved away from the tooth bar when the piston is in an advanced position, so that it prevents the pawl from engaging with those teeth of the tooth bar that are not covered. Through this, it is prevented that a residual amount is discharged from the syringe, which is smaller than the dosing amount which is to be discharged in each dosing step.

Further developments of the means for detachably holding the syringe are described in the documents EP 0656229 B1 and U.S. Pat. No. 5,620,660 A, the entire contents of which are incorporated herein by reference. The documents EP 1724020 B1 and U.S. Pat. No. 7,731,908 B2, the entire contents of which are incorporated herein by reference, describe a further development of the holding devices which permits to detach the syringe from the pipette using only one hand.

The documents EP 0657216 B1 and U.S. Pat. No. 5,620,661 A, the entire contents of which are incorporated herein by reference, describe such a pipette with a sensor for gauging protrusions and deepenings on the syringe flange and associated syringes. The sensor serves to determine the size of the utilized syringe. On the basis of the set step width, an electronics determines the amount of liquid that is discharged in each discharging step. This is indicated on a display.

Further developments of the means for relocating the fixture body are described in the documents DE 4437716 C2, EP 0679439 B1 and U.S. Pat. No. 5,591,408 A, the entire contents of which are incorporated herein by reference. According to EP 0679439 B1 and U.S. Pat. No. 5,591,408 A, a repeater pipette has a constant-step equipment, which fixes the size of the first step for relocating the fixture body for the actuation portion of the syringe piston towards the cylinder fixture for the syringe cylinder to a constant value, which is independent from the setting of the subsequent step sizes. Through this constant reverse stroke in the relocation of the fixture body back to the cylinder fixture after drawing up liquid, a clearance between pipette and syringe is overcome which would compromise the dosing accuracy.

The known manually driven repeater pipettes have the disadvantage that the user must look up in the manual the maximum number of dosing steps possible without refilling the syringe at completely filled syringe with the set dosing volume after performing a reverse stroke, or he/she must determine it by experiment. Moreover, the user must count the performed dosing steps when he/she wants to know the number of further dosing steps which are still possible with the remaining liquid in the syringe. This is awesome and prone to errors notably at small dosing step sizes. In addition, it is disadvantageous that no clearance compensation is ensured in the known repeater pipettes, when at only partial filling of the syringe by means of the pipette, the delivery of the liquid from the syringe is controlled by the pipette. The accuracy of the initial dosings is impaired through this.

The document U.S. Pat. No. 6,254,832 B1, the entire contents of which is incorporated herein by reference, describes a portable, microprocessor controlled pipette with an electric power supply. The pipette has a piston in a cylinder, which is driven by an electric step motor. The pipette can be equipped with tubular pipette tips which can be plugged up onto a shaft at the bottom end of the pipette. By means of entry keys, the dispensing volume can be set which is indicated on a display. By actuating a further key, even the number of dispensing steps can be indicated which the pipette can perform with the set dispensing volume. In the dispensing mode, the number of metering steps which is still possible with the residual amount of sample liquid in the pipette tip is indicated after each dispensing step.

Starting from this, the present invention is based on the goal to provide a method for dosing a liquid using a pipette and a syringe, and a pipette for operating a syringe for dosing a liquid having more favourable utilization properties.

BRIEF SUMMARY OF THE INVENTION

The goal is achieved by a method with the inventive features discussed below.

In the method of the present invention for dosing a liquid, using a pipette with adjustable dosing step size and an indicating equipment and a syringe that can be operated using the pipette, 1.1 the syringe is detachably connected to the pipette, 1.2 at option, the dosing step size is set, or the dosing step size set before is maintained, 1.3 the dosing volume adjusted via the dosing step size is indicated by means of the indicating equipment, 1.4 the maximum possible number of dosing steps without refilling the syringe, with the set dosing step size and completely filled syringe is indicated by means of the indicating equipment, 1.5 liquid is aspirated into the syringe, 1.6 a reverse stroke is performed after the syringe is filled with liquid 1.7 dosing steps are performed, the performed dosing steps are counted and the number of performed dosing steps and/or the number of dosing steps still possible without refilling the syringe is determined and indicated by means of the indicating equipment, 1.8 after performing the maximum number of dosing steps possible without refilling the syringe, either the syringe is detached from the pipette, or steps 1.2 to 1.8 are performed anew by means of the same syringe, wherein in step 1.7, the overall performed number of dosing steps with the syringe with the set dosing step size is counted, and/or the number of dosing steps still possible without refilling the syringe is determined and indicated by means of the indicating equipment.

In the method of the present invention, the maximum number of dosing steps which are possible at completely filled syringe with the set dosing step size after performing a reverse stroke without refilling the syringe is indicated to the user. Further, the number of performed dosing steps and/or the number of dosing steps still possible with the set dosing step size without refilling the syringe is indicated to the user. As the case may be, after executing the maximum number of dosing steps, a residual amount of liquid remains in the syringe, which is smaller than the set dosing volume. After the execution of the maximum number of dosing steps, the user has either the possibility to detach the used syringe from the pipette, and to perform the method anew from on the beginning after the insertion of a new syringe. Or alternatively, the user can utilize the same syringe a number of times. In case that he/she uses the syringe a number of times, the overall number of dosing steps performed by means of the same syringe is indicated by the indicating equipment. In addition or instead of this, after filling the syringe with liquid anew, the number of metering steps still possible without refilling the syringe is determined and indicated by means of the indicating equipment. When a new syringe is detachably connected to the pipette after the separation of the syringe from the pipette, the metering steps executed with the new syringe are counted and/or the number of metering steps still possible without refilling the new syringe is indicated by means of the indication equipment during the execution of the metering steps. Thus, after replacing the syringe the count of executed metering steps is reset to zero. Hence, the user can perform the metering processes easier and with reduced risk of errors.

According to a variant, the indication of the number of executed dosing steps takes place instead of the indication of the still possible number of dosing steps. According to another variant, the number of still possible dosing steps without refilling the syringe is indicated instead of the number of executed dosing steps. In the first mentioned embodiment, it is counted upward, and in the second mentioned embodiment it is counted downward. The number of still possible dosing steps is the difference between the maximum possible number of dosing steps and the number of executed dosing steps. According to a further variant, the number of executed dosing steps and the number of still possible dosing steps is indicated simultaneously up to the complete emptiness of the syringe.

According to one embodiment of the method, one of the two numbers mentioned above is displayed greater than the other one. For instance, during dispensing, the sum of the executed dosing steps is displayed greater than the number of still possible dosing steps.

According to a further embodiment, the method is performed with a pipette that is driven by hand. With the pipette driven by hand, drawing up liquid into the syringe as well as the stepwise delivery of liquid by means of the syringe is performed by means of a mechanical drive equipment, which the user can drive by muscle force.

According to one embodiment of the method, an encoding specifying a syringe volume of the syringe that is connected to the pipette is detected by the pipette, and the dosing volume is determined on the basis of the set dosing step size and the detected encoding, and is indicated by means of the indicating equipment. This embodiment permits the utilization of syringes having different sizes, wherein always that dosing volume is automatically indicated which will be delivered by the respective used syringe with the set dosing step size.

According to a further embodiment, an indication referring to the pick-up of liquid is indicated by means of the indicating equipment before liquid is picked up using the syringe that is detachably connected to the pipette. According to one embodiment, the indication is an upward pointing arrow or another obvious symbol. The operation of the pipette is facilitated through this.

According to a further embodiment, when liquid is being picked up, an indication, blinking or in other ways referring to the actual process of picking up liquid into the syringe and to the execution of a reverse stroke, is indicated by means of the indicating equipment. Through this, the user is instructed to fill the syringe completely with liquid as completely as possible, and to perform the reverse stroke. Operating errors and dosing errors can be avoided through this.

According to a further embodiment, after the complete execution of the reverse stroke, the set dosing volume and the number of performed dosing steps is indicated by means of the indicating equipment. Thus, when dispensing, the user can always inform himself about the set dosing volume and the number of executed dosings.

According to a further embodiment, an indication referring to the delivery of liquid is indicated after the complete execution of the reverse stroke. According to one embodiment, the indication is a downward pointing arrow or another obvious symbol. The operation of the pipette is facilitated through this.

According to a further embodiment, after performing the maximum possible number of dosing steps, an indication referring to the optional discharge of residual liquid from the syringe and to detaching the syringe from the pipette or to picking up liquid using the same syringe is indicated by means of the indicating equipment. According to one embodiment, the indication comprises one downward and one upward directed arrow or other obvious symbols. The operation of the pipette is facilitated through this.

According to a further embodiment, after discharging residual liquid from the syringe, an indication referring to detaching the syringe from the pipette is indicated by means of the indicating equipment. According to a further embodiment, this indication comprises a downward directed arrow or another obvious symbol. The operation of the pipette is facilitated through this.

According to a further embodiment, an indication is indicated by means of the indicating equipment only then when a syringe is being detachably connected to the pipette, and/or the indication expires when the syringe is being separated from the pipette. An accumulator or another electric power supply of the pipette is prevented from deterioration through this.

According to a further embodiment, after detachably connecting the pipette to the syringe and before picking up liquid into the syringe, an indication referring to positioning the pipette into a lower end position for picking up liquid is indicated by means of the indicating equipment when the pipette is not in the lower end position for picking up liquid. According to one embodiment, the indication is a downward directed arrow or another obvious symbol for bringing the pipette into the lower end position. The operation of the pipette is facilitated through this.

According to a further embodiment, after the execution of at least one dosing step and before the execution of the maximum possible number of dosing steps, upon change of the setting of the dosing step size, the newly set dosing volume and the maximum possible number of further dosing steps with the newly set dosing volume without refilling the syringe are indicated by means of the indicating equipment, and the executed number of further dosing steps with the newly set dosing volume is counted and indicated by means of the indicating equipment. Through this, after changing the setting of the dosing step size, the user gets the information about the dosing volume, the maximum possible number of further dosing steps and the executed number of further dosing steps.

According to a further embodiment, after changing the dosing step size and subsequent resetting of the dosing step size to the value set before, the maximum possible number of further dosing steps with the dosing step size set before and without refilling the syringe is indicated by means of the indicating equipment, and the dosing steps executed by means of the newly set dosing step size after the resetting, or the overall performed dosing steps before and after the resetting, are counted and indicated by means of the indicating equipment. Through this, after reverting to the previous dosing step size, the user gets the information how many dosing steps he/she can still perform with this dosing volume and how many dosing steps he/she has overall executed with this dosing volume with the same syringe.

According to a further embodiment, an indication referring to the execution of a reverse stroke is indicated by means of the indicating equipment in case of performing dosing steps after incomplete pick-up of liquid into the syringe, for so long until the reverse stroke is executed by one or several dosing steps, and subsequent dosing steps are counted and indicated by means of the indicating equipment. Through this, it is ensured that a reverse stroke is made even after partial pick-up of liquid, which overcomes a clearance between pipette and syringe and dosing inaccuracies accompanied by this. Moreover, the number of subsequently executed dosing steps is indicated to the user even after incomplete filling of the syringe. The operation is all in all facilitated through this. This is advantageous notably when precious liquids or liquids available only in small amounts are dosed, which do not suffice for completely filling a syringe.

The pipette of the present invention for handling a syringe has

- a bar-shaped housing,
- a fixture with an opening at the lower end of the housing for putting in a syringe with a fastening portion on the upper edge of a cylinder,
- a fixture body with a further fixture and a further opening on the lower end of the housing, for putting in a further fastening portion of a piston of the syringe,
- means for detachably holding the fastening portion in the fixture and the further fastening portion in the further fixture,
- means for relocating the fixture body within the housing in the longitudinal direction of the housing,
- which comprise a draw-up lever, activated from the outside of the housing, for picking up liquid into the syringe,
- an actuation button, activated from the outside of the housing, for stepwise discharging liquid from the syringe,
- an adjusting element, adjustable from the outside of the housing for setting a dosing step size,
- means for detecting the dosing step size set by means of the adjusting element,
- means for detecting a syringe that is detachably connected to the pipette,
- means for detecting the execution of a dosing step by actuating the actuation button,
- an electronic control equipment, connected to the means for detecting,
- an electronic indicating equipment, connected to the electronic control equipment,
- wherein the control equipment is configured such that upon syringe inserted into the pipette, it determines the dosing volume based on the set dosing step size and the maximum possible number of dosing steps without refilling the syringe, with the set dosing step size and completely filled syringe, and indicates it by means of the indicating equipment, and determines the number of executed dosing steps and indicates the number of performed dosing steps and/or the number of still possible dosing steps without refilling the syringe by means of the indicating equipment.

The means for detecting a syringe that is detachably connected to the pipette send a signal to the control equipment that a syringe is inserted. Then, the control equipment determines the maximum possible number of dosing steps which are possible without refilling the syringe after completely filling the syringe, based on the detected dosing step size and on data concerning the inserted syringe existing in the control equipment. By means of the indicating equipment, the control equipment indicates the dosing volume which is determined from the dosing step size and the determined maximum number of dosing steps. When dosings take place, this is signalized to the control equipment by means of the means for detecting the execution of a dosing step. The control equipment counts the dosing steps and indicates the respective number of executed dosing steps by means of the indicating equipment. Thus, the user is informed about the set dosing volume, the maximum possible number of dosing steps and the respective number of executed dosing steps. According to a variant, the control equipment is configured such that there is an indication of the number of executed dosing steps instead of the indication of the number of dosing steps that are still possible without refilling the syringe. According to a further variant, the control equipment is configured such that the indication of the number of dosing steps still possible without refilling the syringe takes place instead of the indication of the number of executed dosing steps. According to another variant, the control equipment is configured such that the number of executed dosing steps and the indication of the number of dosing steps that are still possible without refilling the syringe are displayed at the same time.

According to a further embodiment, the control equipment is configured such that it displays one of the two mentioned numbers greater than the other one.

According to one embodiment, the pipette is a pipette driven by the muscle force of the user. According to a further embodiment, the pipette comprises mechanical drive equipments for driving the fixture body, which the user can drive by muscle force.

According to one embodiment, the pipette comprises a sensor for detecting an encoding imposing the syringe volume on a syringe that is detachably connected to the pipette. Through this, it is possible to use the pipette with syringes having different volumes, wherein based on the set dosing step size and the determined syringe volume, the control equipment always determines the set dosing volume and displays it via the indicating equipment. The sensor is preferably a ring sensor. According to a preferred embodiment, the sensor for detecting an encoding is at the same time the means for detecting a syringe that is detachably connected to the pipette.

According to a further embodiment, the control equipment is configured such that after the execution of the maximum possible number of dosing steps and refilling the same syringe, it determines the number of dosing steps all in all performed with the syringe with the set dosing step size, and/or it determines the number of dosing steps still possible without refilling the syringe and indicates it by means of the indicating equipment.

According to a further embodiment, the control equipment is configured such that it indicates an indication referring to the pick-up of liquid by means of the indicating equipment before liquid is picked up using the syringe that is detachably connected to the pipette. According to one embodiment, the control equipment triggers this indication when the means for detecting a syringe signalize that a syringe is detachably connected to the pipette before the means for detecting the execution of a dosing step signalize a dosing step.

According to a further embodiment, the control equipment is configured such that when liquid is being picked up, it displays an indication, blinking or in other ways referring to the actual process of picking up liquid into the syringe and to the execution of a reverse stroke, by means of the indicating equipment for so long until a reverse stroke has been performed completely. For this purpose, the pipette comprises, according to one embodiment, means for detecting a relocation of the fixture body into a lower end position for detachably connecting the pipette to a syringe, and means for detecting a relocation of the fixture body into an upper end position for completely filling a syringe, wherein these means for detecting are connected to the electronic control equipment. These means for detecting send a signal to the control equipment that a syringe has been filled completely. The execution of the reverse stroke can be signalized to the control equipment by the means for detecting the execution of a dosing step in case that the reverse stroke is triggered by the actuation button.

According to a further embodiment, there are means for detecting a reverse stroke, which detect the actuation of a transmission element for the reverse stroke and are connected to the electronic control equipment. According to a further embodiment, the transmission element for the reverse stroke is coupled to the fixture body, so that it is taken along in the relocation of the fixture body into the upper end position for filling a syringe completely, and is taken along in the opposite direction in the reverse stroke, and the means for detecting the relocation of the fixture body into the upper end position are the means for detecting the reverse stroke at the same time. According to one embodiment, these means for detecting are formed by one single micro-switch, which is switched into different switching states by the transmission element for the reverse stroke when the position for filling a syringe completely is reached and after the execution of the reverse stroke.

According to a further embodiment, the control equipment is configured such that after the complete execution of the reverse stroke, it indicates the set dosing volume and the number of performed dosing steps by means of the indicating equipment. The execution of the reverse stroke is signalized to the control equipment by the means for detecting the execution of a dosing step or by the means for detecting the execution of a reverse stroke. The execution of a dosing step is signalized to the control equipment by the means for detecting the execution of a dosing step. The control equipment counts the executed dosing steps and indicates them.

According to a further embodiment, the control equipment is configured such that by means of the indicating equipment, it indicates an indication referring to the delivery of liquid after the complete execution of the reverse stroke. The execution of the reverse stroke is signalized to the control equipment by the means for detecting the execution of a dosing step or by the means for detecting the execution of a reverse stroke.

According to a further embodiment, the control equipment is configured such that after performing the maximum possible number of dosing steps, it indicates by means of the indicating equipment an indication referring to the optional discharge of residual liquid from the syringe and to detaching the syringe from the pipette or to picking up liquid using the same syringe. According to a further embodiment, the control equipment is configured such that it determines the execution of the maximum possible number of dosing steps by comparing the number of executed dosing steps with the determined maximum number of dosing steps for emptying the syringe.

According to a further embodiment, the control equipment is configured such that after discharging residual liquid from the syringe, it indicates by means of the indicating equipment an indication referring to detaching the syringe from the pipette. The discharge of residual liquid from the syringe is signalized to the control equipment by the means for detecting the relocation of the fixture body into a lower end position for inserting the syringe. In the lower end position, the fixture body is displaced towards the fixture for the syringe cylinder as far as possible. The control equipment shows this sign then when a dosing has taken place before. This can be signalized to the control equipment by the means for detecting the execution of a dosing step.

According to a further embodiment, the control equipment is configured such that after detachably connecting the pipette to the syringe and before picking up liquid into the syringe, it indicates by means of the indicating equipment an indication referring to positioning the pipette into a lower end position for picking up liquid when the pipette is not in the lower end position for picking up liquid. This is signalized to the pipette by the means for detecting the relocation of the fixture body into a lower end position for inserting a syringe.

According to a further embodiment, the control equipment is configured such that after the execution of at least one dosing step and before the execution of the maximum possible number of dosing steps, upon change of the setting of the dosing step size, it indicates by means of the indicating equipment the newly set dosing volume and the maximum possible number of further dosing steps without refilling the syringe with the newly set dosing volume, and the number of executed further dosing steps with the newly set dosing volume is determined and indicated by means of the indicating equipment. The change of the adjustment of the dosing step size is signalized to the control equipment by the means for detecting the set dosing step size. The control equipment determines the number of further dosing steps based on existing data of the syringe volume and of the number of dosing steps executed with the dosing step size that was set before.

According to a further embodiment, the control equipment is configured such that after changing the dosing step size and subsequent resetting of the dosing step size to the value set before, it indicates by means of the indicating equipment the maximum possible number of further dosing steps without refilling the syringe with the dosing step size set before, and counts and indicates by means of the indicating equipment the dosing steps executed by means of the newly set dosing step size after the resetting, or the overall performed dosing steps before and after the resetting. According to one embodiment, upon change of the dosing step size, the control equipment memorizes the value of the dosing step size set before, and the number of therewith executed dosing steps.

According to a further embodiment, the control equipment is configured such that in case of performing dosing steps after incomplete pick-up of liquid into the syringe, it indicates by means of the indicating equipment an indication referring to the execution of a reverse stroke for so long until the reverse stroke is executed by one or several dosing steps, and counts and indicates by means of the indicating equipment the dosing steps subsequent to this. The incomplete pick-up of liquid is signalized to the pipette in that the means for detecting dosing steps signalize the execution of dosing steps without that the means for detecting a relocation of the fixture body into the upper end position signalize the relocation of the fixture body into the upper end position. The control equipment can perform the number of dosing steps necessary for executing a reverse stroke depending on the set dosing step size, which is signalized to the control equipment by the means for detecting the dosing step size. According to one embodiment, the control equipment resorts to a memorized table for this purpose, in which the number of dosing steps for the execution of a reverse stroke is specified depending on the setting of the dosing step size.

The means for detecting are preferably realised in one or several of the following ways: micro-switch, Hall-sensor, Hall-sensor with magnet, Reed contact with magnet, photosensor, pressure sensor (for instance touch-screen sensor), capacitive sensor or circuit board with meander-shaped conducting path, actuated by a carbon switch capsule on a flexible foil.

The control equipment is preferably a micro-controller.

The means for holding the fastening portion in the fixture and the further fastening portion in the further fixture are preferably realised such like this is described in the documents from the state of the art mentioned in the beginning. The means for relocating the fixture body within the housing are preferably realised such like this is described in the documents from the state of the art mentioned in the beginning. The sensor for detecting an encoding of a syringe and the encoding of the syringe are preferably realised such like this is described in the documents from the state of the art mentioned in the beginning. In this respect, reference is made to the documents DE 29 26 691 C2, U.S. Pat. No. 4,406,170A, DE 44 37 716 C2, EP 0 679 439 B1, U.S. Pat. No. 5,591,408A, EP 056 229 B1, U.S. Pat. No. 5,620,660 A, EP 1 724 020 B1, U.S. Pat. No. 7,731,908 B2, EP 0 657,216 B1, U.S. Pat. No. 5,620,661 A, whose content is hereby incorporated into the present application.

BRIEF DESCRIPTION OF THE SEVERAL VIEWS OF THE DRAWINGS

The present invention will be explained in more detail in the following by way of the attached drawings of an example of its realisation. In the drawings show:

FIG. 4 the same configuration in a perspective partial view from the side;

FIG. 5 the same configuration in a housing half of the pipette in a perspective partial view from another side;

FIG. 21 method for dosing upon partial filling of the syringe in a flow chart;

FIG. 22 table with the number of dosing steps for executing a reverse stroke, at different settings of the dosing step size.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

In the present application, the designations "up" and "down" refer to the orientation of the pipette in which the bar-shaped housing is oriented vertically, and the fixture for the syringe is disposed at the downside.

Figure 1:
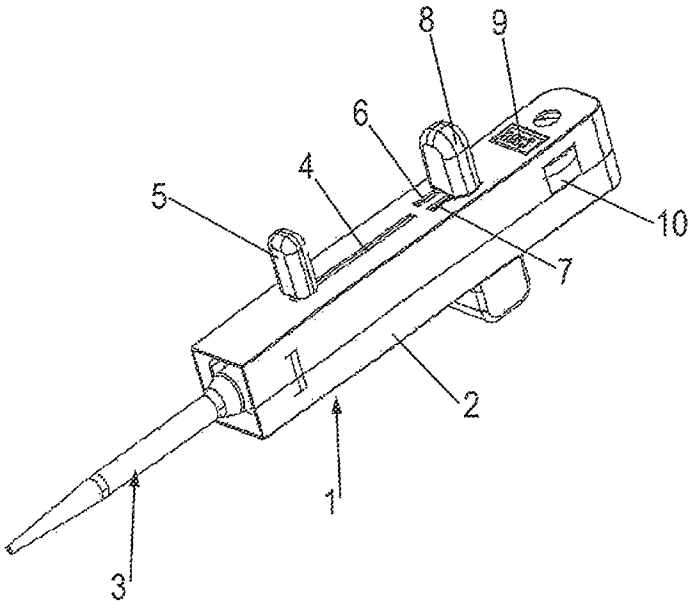
FIG. 1 a pipette of the present invention with syringe held therein, in a perspective view from the side.

According to FIG. 1, a pipette 1 has a bar-shaped housing 2, in which a syringe 3 is held at the downside. From a side wall of the housing 2, a draw-up lever 5 projects from the housing 2 above a straight slit 4. An actuation button 8 of a tooth bar pawl control projects from the same side wall of the housing above two further slits 6, 7. Above it, a LCD display 9 is countersunk into the same side wall of the housing 2. Segments of a dial 10 project from openings in the neighbouring side wall.

Figure 2:
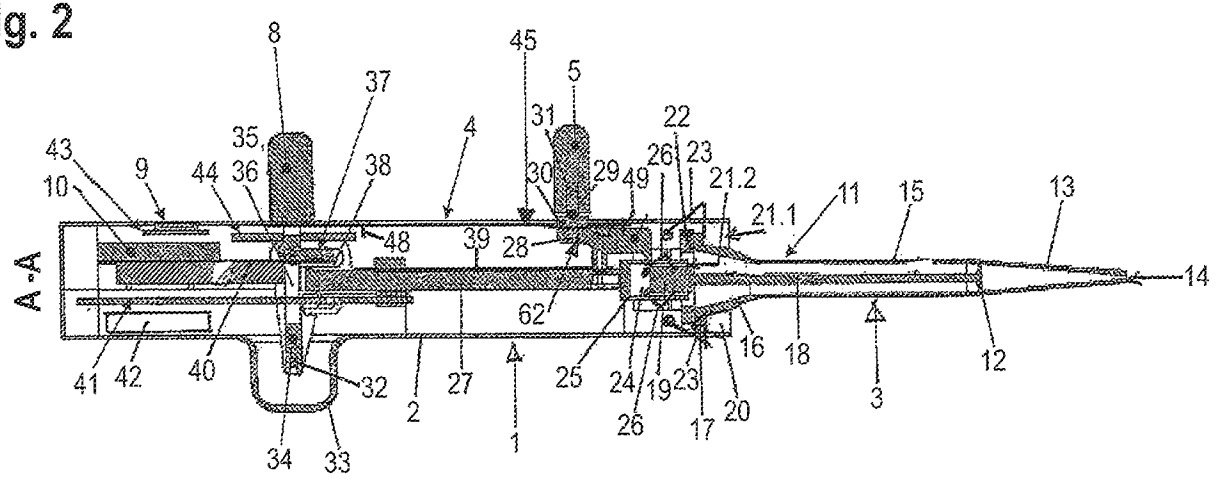
FIG. 2 the same pipette in a longitudinal section.

According to FIG. 2, the syringe 3 has a cylinder 11 and a piston 12 movably arranged therein. The cylinder 11 has a conical portion 13 with a hole 14 for the passage of liquids at the downside, and above it a cylindrical portion 15 in which the piston 12 can be displaced. At the upside, the cylinder 11 has a fastening portion 16 with a circumferential flange 17. A piston rod 18 projects towards the upside from the piston 12, which has a further fastening portion 19 with several circumferential bulges (not shown).

The syringe 3 is arranged with its flange 17 in a fixture 20 at the lower end of the housing 2, which has an axially directed opening 21.1 for insertion and withdrawing of the syringe 3 at the lower end of the housing 2. With its topside, the syringe 3 pushes against a pressure-sensitive ring sensor 22, which scans projections on the upper edge of the flange 17. The flange 17 is kept in the housing 2 in this position by means of gripping levers 23.

The further fastening portion 19 of the piston 12 is disposed in a further fixture 24 in a hollow-cylindrical fixture body 25. The latter has a further axially oriented opening 21.2 for inserting the fastening portion 19. The further fastening portion 19 is held with further gripping levers 26, which engage between the bulges of the further fastening portion 19 or clamp it in.

The fixture body 25 is fixedly connected to a tooth bar 27, which extends below the slit 4 in the longitudinal direction of the housing 2.

A draw-up lever mount 28 is fixed on the fixture body 25 and on a lower part of the tooth bar 27.

Further, there is a draw-up lever carrier 29, which bears against the lower side of the edges of the slit 4 with a sliding board 30. The draw-up lever carrier 29 has an upward-projecting post 31 which grips through the slit 4. Outside of the housing 2, the draw-up lever 5 is fixed on the post.

In the upper half of the housing 2, a dosing lever 34 is pivotally mounted in a hinge bearing 32 in a bulge 33 of the side wall of the housing 2 opposite to the slit 4. The dosing lever 34 has two spaced apart legs 35, 36, which stand out of the two slits 6, 7 on the opposite side wall of the housing 2. The actuation button 8 is fixed there on the projecting ends of the legs 35, 36.

Between the two legs 35, 36 of the dosing lever 34, a pawl 37 is pivotally mounted. The pawl 37 is arranged above the toothing 39 of the tooth bar 27 with a pawl tooth 38. The dosing lever 34 is pressed into the position of FIG. 2 by a not shown spring device. Against the action of the spring device, the dosing lever 34 can be swung towards the downside by actuating the actuation button 8. The pawl 37 is pushed towards the toothing 39 of the tooth bar 27 by a not shown further spring device.

A movable covering 40 is arranged between pawl 37 and tooth bar 27. The covering 40 can be moved by turning the dial 10 which projects laterally out of the housing 2, so that it covers the toothing 39 of the tooth bar 27 more or less.

Further, a circuit board 41 with electronics is arranged in the upper half of the housing 2. Here is also situated a power supply in the form of batteries or accumulators 42.

A further sensor 43 is assigned to the dial 10, which acquires the position of the dial 10. The measurement values determined by the ring sensor 22 and the further sensor 43 are forwarded to the electronics via cable.

The code indicated on the flange 17 designates the size of the respective syringe 3. From the measurement signals provided by the ring sensor 22, the electronics determines the respective syringe size, and from the setting of the dial 10 the respective step width. From these it calculates the set dosing volume and displays it on the display 9.

At the inside, the slits 6, 7 are covered by a diaphragm 44 connected to the dosing lever 34.

According to FIGS. 3 to 5, a flexible cover stripe 45 exists in the housing 2 below slit 4 in order to cover up the slit 4. The cover stripe 45 is made of polypropylene. According to FIG. 8, the cover stripe 45 has eyes 46, 47 at its ends, which are fixed on pins 48, 49 according to FIG. 2, which project from the inner side of that side wall of the housing 2 which has the slit 4.

Figure 3:
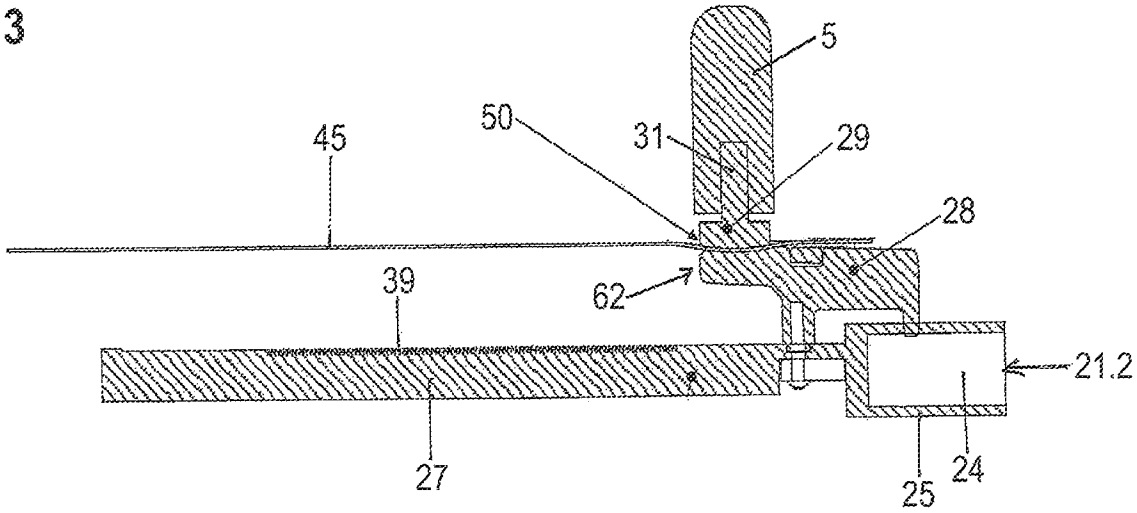
FIG. 3 fixture body with tooth bar, connection element, draw-up lever and cover tape of the same pipette in a magnified partial section in the longitudinal direction.
Figure 7:
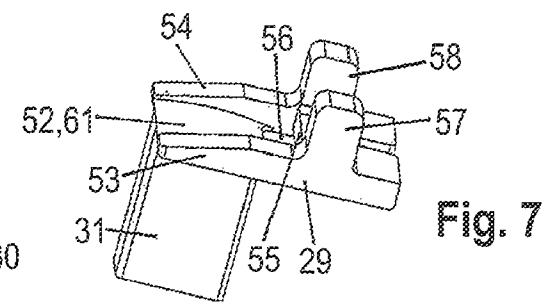
FIG. 7 the draw-up lever carrier in a perspective view from the other side.
Figure 6:
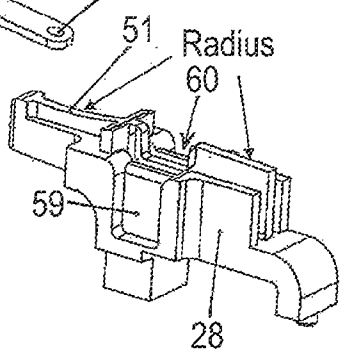
FIG. 6 the draw-up lever mount in a perspective view from the side.

According to FIGS. 3 to 5, the cover stripe 45 runs through a channel 50 between draw-up lever mount 28 and draw-up lever carrier 29. According to FIGS. 6 and 7, the channel 50 is limited on opposing sides by a lateral surface 51 with a radius of the draw-up lever mount 28 and by a further lateral surface 52 with corresponding radius of the draw-up lever carrier 29. The two lateral limits of the channel 50 are formed by two stripe-shaped side walls 53, 54 of the draw-up lever carrier 29. These are connected to each other by a cross member 55 in a distance from the lateral surface 52 that has the radius. Between the further lateral surface 52 having the radius and the cross member 55, the draw-up lever carrier has a breakthrough 56. From one side of the cross member 55 project two projections 57, 58, which can be put into corresponding pockets 59, 60 of the draw-up lever mount 28. The two stripe-shaped side walls 53, 54 are bridged by a front wall 61, which has the further lateral surface 52 with the radius at the downside, and from which the post 31 projects at the upside.

Figure 8:
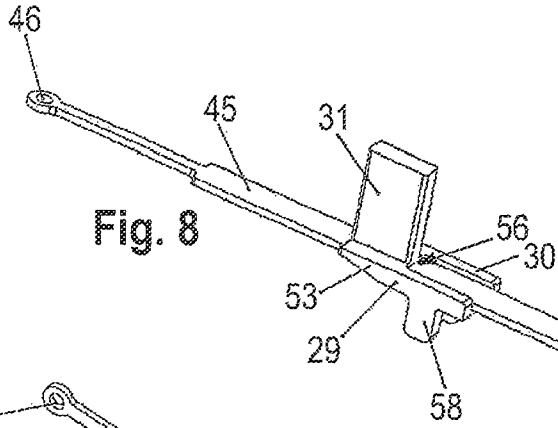
FIG. 8 the draw-up lever carrier with inserted cover tape in a perspective view from the side.
Figure 9:
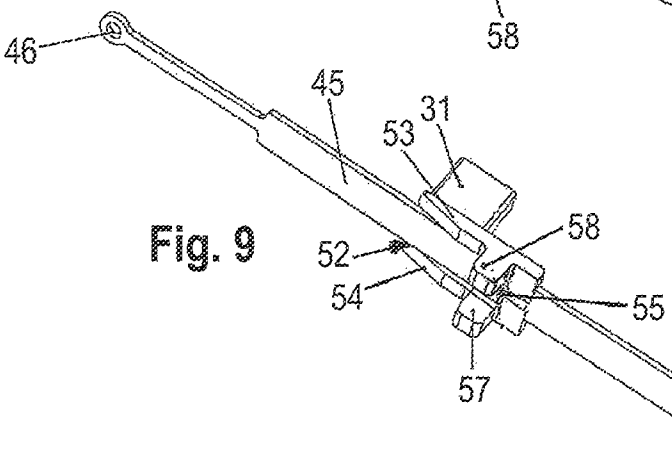
FIG. 9 the draw-up lever carrier with inserted cover tape in a further perspective view.

According to FIGS. 8 and 9, the draw-up lever carrier 29 can be pre-assembled with the cover stripe 45 by guiding the cover stripe 45 along the further lateral surface 52 and across the breakthrough 56, so that it runs on the topside of the cross member 55 between the two stripe-shaped side walls 53, 54. In this configuration, the draw-up lever carrier 29 can be connected to the draw-up lever mount 28 by putting the projections 57, 58 into the pockets 59, 60 and draw-up lever carrier 29 and draw-up lever mount 28 are glued together or snapped together by suitable snapping means. The cover stripe 45 is then arranged in the channel 50 between lateral surface 51, further lateral surface 52 and side walls 53, 54. At one side next to the draw-up lever carrier 29, the cover stripe 45 rests on a projecting rib 51.1 of the draw-up lever mount 28 that extends in the longitudinal direction of the slit 4 (compare FIGS. 4 to 6).

Draw-up lever mount 28 and draw-up lever carrier 29 form together a connection element 62 between fixture body 25 and draw-up lever 5 (compare FIG. 2, 3, 4).

According to FIGS. 4 and 5, the draw-up lever mount 28 has wings 63, 64 which project from both sides. In the example, the wings 63, 64 have a cylindrical shape. They engage into grooves 65, 66 on two opposing side walls of the housing 2. The grooves 65, 66 are limited by an edge of a housing half at one side, and on the other side by a ledge of a chassis in which parts of the drive mechanics of the pipette 1 are mounted.

According to FIG. 2, on the eyes 46, 47, the cover stripe 45 is held stretched at the inner side of the slit 4 by the two pins 48, 49 according to FIG. 8, 9. According to FIG. 3, it is vaulted on the plane in which it extends on both sides of the channel 50 due to the radii of the lateral surfaces 51, 52 of the channel 50. Close bearing of the cover stripe 45 against the edges of the slit 4 is obtained through this.

Figure 10:
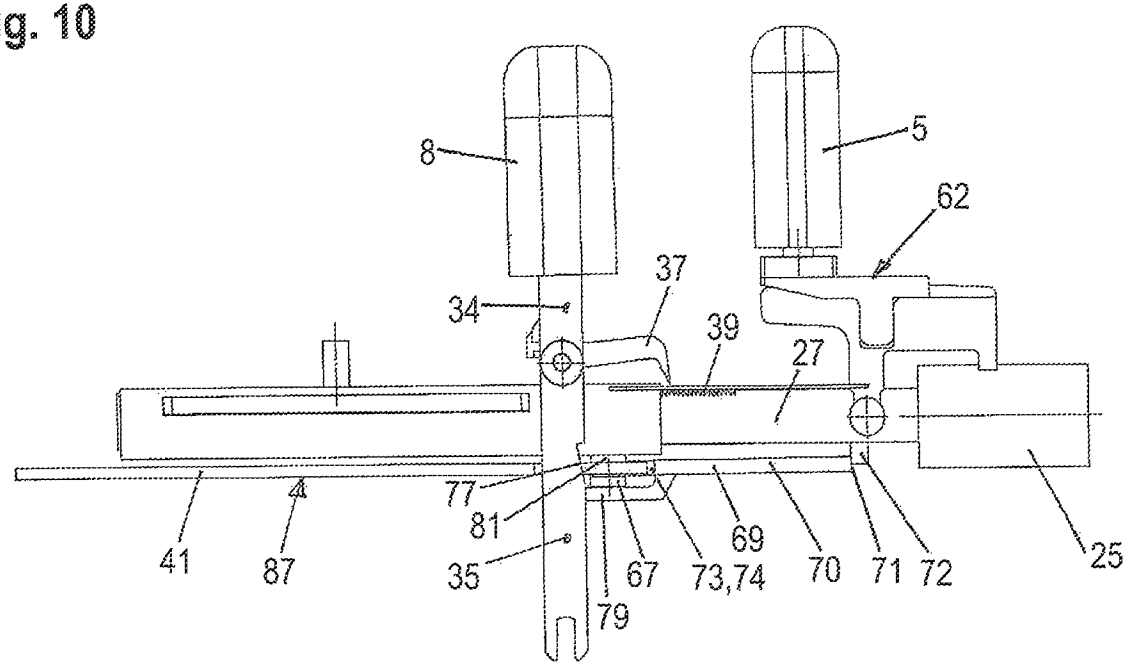
FIG. 10 fixture body with means for relocating the fixture body, comprising draw-up lever, actuation button, pawl, tooth bar, transmission element for a reverse stroke, upper and lower end position switch, in the upper end position in a longitudinal section.
Figure 11:
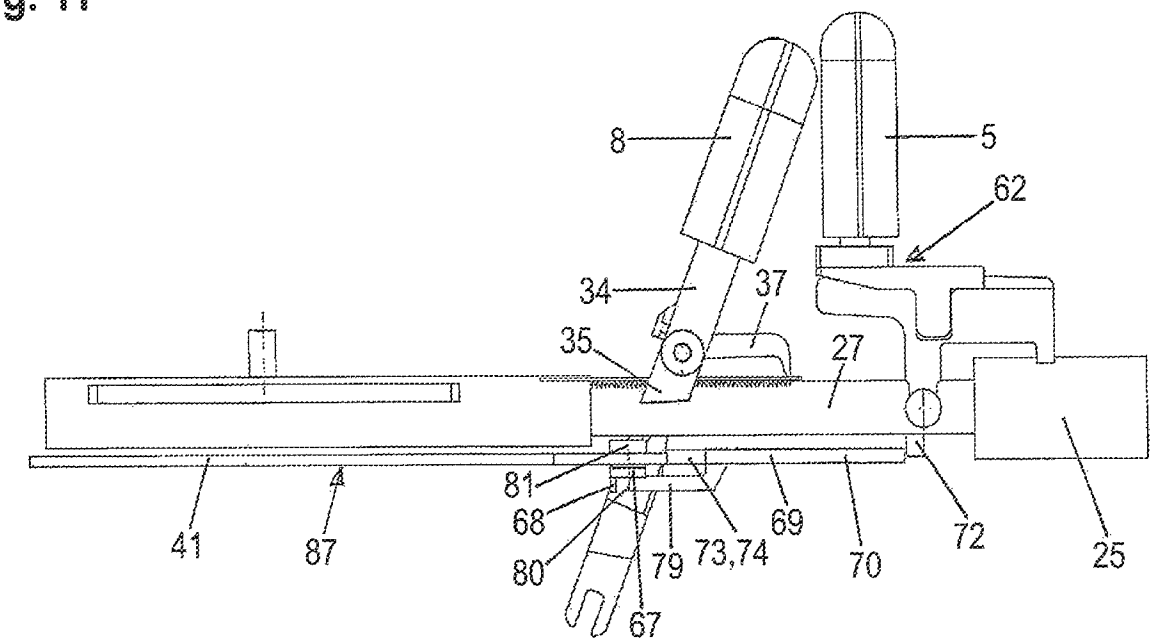
FIG. 11 the same arrangement after a reverse stroke in the same longitudinal section, omitting the front leg of the dosing lever.

According to FIGS. 10 and 11, on its lower end at the side facing away from the tooth bar 27, the circuit board 41 carries an upper end position switch 67, formed as a micro-switch, for detecting the upper end position of the fixture body 25. In the upper end position, the fixture body 25 is maximally dislocated away from the fixture 24 (compare FIG. 2) in order to fill a syringe 3 completely. The upper end position switch 67 is a touch button with a touch lever 68 which projects outwardly with respect to the circuit board 41.

The upper end position switch 67 serves for detecting a reverse stroke at the same time. For this purpose, a transmission element 69 for triggering a reverse stroke is arranged adjacent to the tooth bar 27 within the housing of the pipette. The transmission element 69 has a stripe-shaped transmission portion 70, which is guided parallel to the tooth bar 27 in the housing of the pipette and is relocatable. The stripe-shaped transmission portion 70 has a lower end 71 of the transmission element, which is situated in the relocation area of a lower stop 72 which protrudes from the side of the tooth bar 27 when the transmission element 69 is relocated downward.

Further, the transmission element 69 has two control arms 73, 74 at its top, which extend in the plane (vertical to FIGS. 10 and 11) of the circuit board 41 and encompass the lower end of the circuit board 41 on both sides. The transmission element 69 can be relocated such that the control arms 73, 74 arrive in the relocation area of chamfered stop edges 77, 78 on the legs 35, 36 with their control arm ends 75, 76 (FIGS. 10 to 13).

Further, the transmission element 69 has a switch arm 79 at its top, which encompasses the circuit board 41 in a distance on that side on which the upper end position switch 67 is arranged. The switch arm 79 is configured such that it actuates or releases the touch lever 68 of the upper end position switch 67 with its upper switch arm end 80 when the transmission element 69 is relocated. In the situation of FIG. 10, the switch arm 79 actuates the upper end position switch 67, the touch lever 68 being covered by the leg 35 of the dosing lever 34. In FIG. 11 is shown how the switch arm 79 releases the touch lever 68 of the upper end position switch 67.

Figure 12:
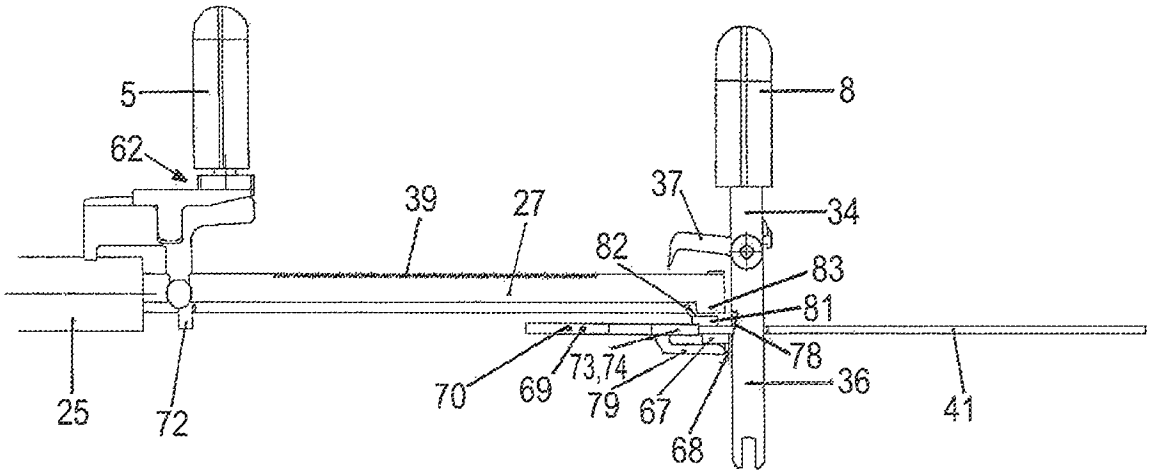
FIG. 12 the same arrangement shortly before reaching the lower end position in a longitudinal section, seen from the opposing side.
Figure 13:
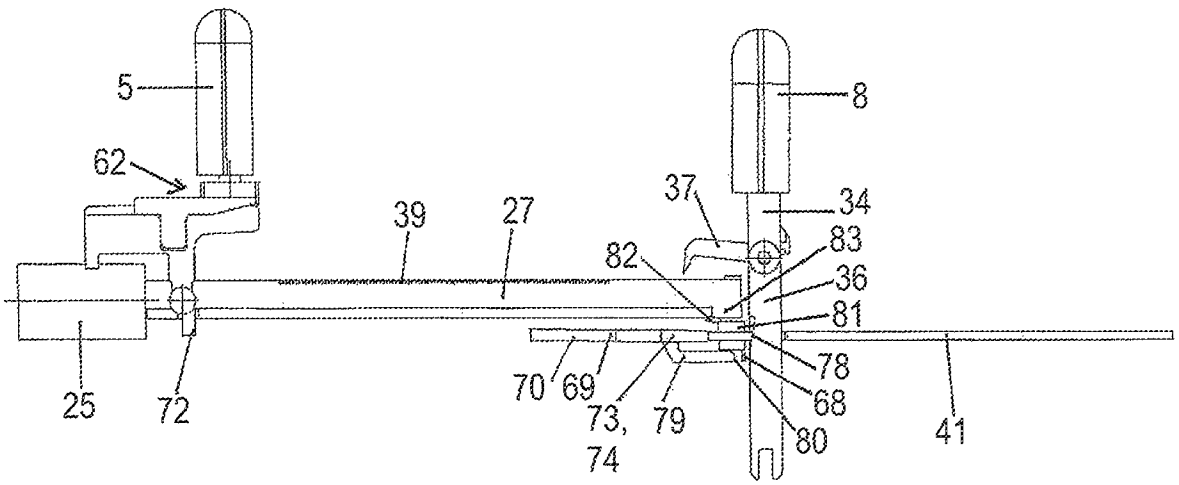
FIG. 13 the same arrangement in the lower end position in the same longitudinal section.

According to FIGS. 12 and 13, next to its lower end at the side facing the tooth bar 27, the circuit board 41 carries a lower end position switch 81, formed as a micro-switch. The lower end position switch 81 is a touch button with a touch lever 82 projecting towards the circuit board 41. The touch lever 82 is situated in the relocation area of an upper stop 83 which protrudes from the opposite side of the tooth bar 27. In FIG. 12, the upper stop 83 releases the touch lever 82, and in FIG. 13 it actuates it.

Figure 14:
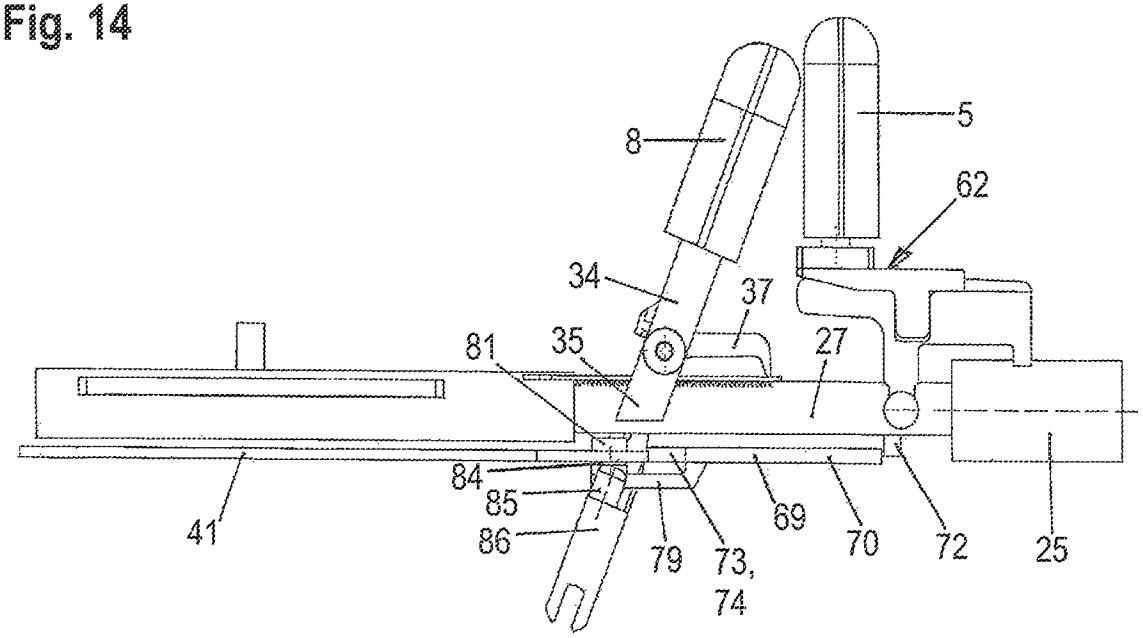
FIG. 14 the same arrangement in a further longitudinal section through a dosing step sensor for detecting dosing steps when this switch is actuated.
Figure 16:
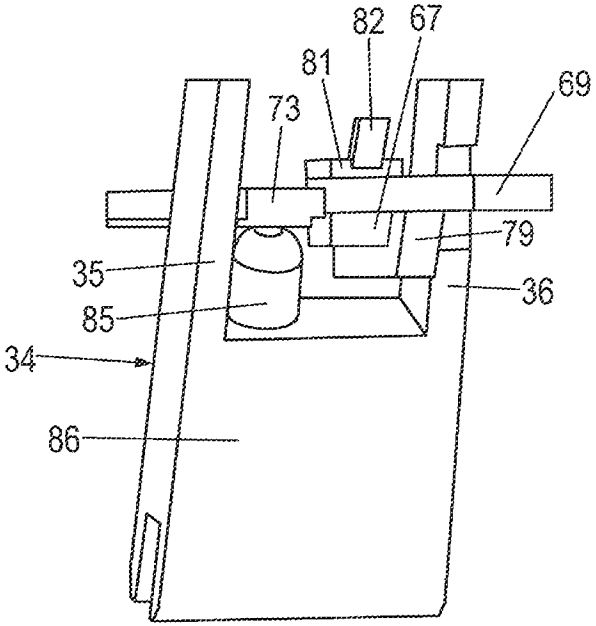
FIG. 16 the same arrangement with actuated dosing step sensor in the same perspective partial view.
Figure 15:
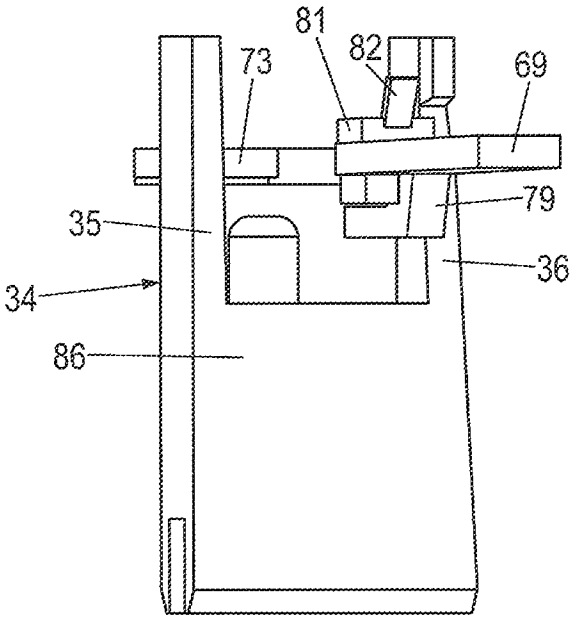
FIG. 15 the end position switches and the dosing step sensor for detecting a dosing step with the dosing lever and a transmission element for a reverse stroke, with not actuated dosing step sensor in a perspective partial view.

According to FIGS. 14 to 16, a dosing step sensor 84 for detecting dosing steps is arranged on the circuit board 41 adjacent to the upper end position switch 67. The dosing step sensor 84 is also a touch button. The touch organ is preferably a membrane made of plate which can be deformed from a stable, outward vaulted starting position to an unstable, inward vaulted position in which is closes an electric circuit. After release, the plate membrane reverts automatically from the unstable to the stable position in which the electric circuit is opened.

With its membrane, the dosing step sensor 84 is situated in the pivot area of a pin 85 made of silicone, which is arranged on a dosing lever base 86 of the dosing lever 34, connecting the legs 35, 36 of the dosing lever 34 and mounted on the hinge bearing 32.

According to FIGS. 2, 10 and 11, the circuit board 41 carries an electronic control equipment 87, which is wired to the ring sensor 22, the further sensor 43 for detecting the rotational position of the dial 10, the upper end position switch 67, the lower end position switch 81, the dosing step sensor 84 and the display 9. The control equipment 87 is further connected to the accumulator 42.

In the utilization of the pipette 1 from FIGS. 1 to 16, a syringe 3 with a syringe size selected by the user is detachably connected to the pipette at first, by putting it into the fixture 20 in the fastening portion 16, and into the fixture 24 with the fastening portion 19, so that the flange 22 is grasped by the gripping levers 23 and the fastening portion 19 by the gripping levers 26.

The ring sensor 22 scans the encoding on the flange 17 of the syringe 3. Based on the signals furnished by the ring sensor 22, the control equipment 87 detects that a syringe 3 is inserted, and switches the display 9 on. Based on the signals furnished by the ring sensor 22 and the sensor 43, the control equipment 87 determines the set dosing volume and indicates it on the display 9. As the case may be, the user changes the setting of the dosing volume by means of the dial 10, and the changed dosing volume is indicated by the display 9.

Further, the control equipment 87 determines the maximum possible number of dosing steps for emptying the syringe 3 after complete filling and indicates it. Further, the control equipment 87 gives a sign by an upward directed arrow on the display 9 that liquid can be picked up into the syringe 3.

In order to draw up liquid through the opening 14 of the syringe 3, the draw-up lever 5 is pushed upward from the position of FIGS. 1, 2 and 13. In the lower end position of the fixture body 25, the upper stop 83 actuates the touch lever 82 of the lower end position switch 81 according to FIG. 13. When the fixture body 25 leaves the lower end position, the upper stop 83 releases the lower end position switch 81, like this is shown in FIG. 12. As soon as the lower end position switch 81 signalizes this to the control equipment 87, the latter triggers a blinking of the indication on the display 9.

When the draw-up motion is ended, the lower stop 72 takes the transmission element 69 along, so that the switch arm 79 pushes against the touch lever 68 of the upper end position switch 67. By this actuation of the end position switch 68, it is signalized to the control equipment 87 that the syringe 3 has been filled completely.

Before the set dosing volume can be delivered stepwise, a reverse stroke must be done. This happens by actuating the actuation button 8. In this, the stop edges 77, 78 hit the control arms 73, 74 and relocate the transmission element 69 downward. The transmission element 69 takes the tooth bar 27 along via the lower stop 72. The clearance is removed from the system by this reverse stroke. Moreover, the switch arm 79 is released from the touch lever 68 of the upper end position switch 67 in this, whereby it is signalized to the control equipment 87 that a reverse stroke has been made.

After the reverse stroke, the display 9 stops blinking and indicates that zero dosing steps have been executed. Further, by displaying a downward directed arrow, the display 9 indicates that liquid can be delivered.

Thereafter, the drawn-up amount of liquid can be delivered in small steps by pushing the actuation button 8 repeatedly downward against the action of the spring equipment. In this, the further spring equipment pushes the pawl 37 with the pawl tooth 38 against the covering 40 until the pawl tooth 38 reaches the lower end of the covering 40. Thereafter, the pawl 37 engages with the pawl tooth 38 into the toothing 39 of the tooth bar 27, and takes the tooth bar 27 somewhat along in the further downward swinging of the dosing lever 34. When the dosing lever 34 is swung up to its arrival on a lower stop, the relocation of the tooth bar 27 depends on a position of the covering 40 set by means of the dial 10. After unloading the actuation button 8, it is pushed upward by the spring equipment, and a further dosing step can be performed.

In each dosing step, the pin 85 hits the dosing step sensor 84 and actuates it (compare FIG. 14). This signalizes the execution of a dosing step to the control equipment 87. The control equipment 87 adds up the executed dosing steps and indicates the respective number of executed dosing steps on the display 9.

Dispensing without having to refill the syringe 3 is possible for so long until the residual amount of liquid remained in the syringe is smaller than the set dosing amount. A residual stroke blocker provides that the covering 40 is swung against the bottom side of the pawl 37, so that the pawl tooth 38 can no more engage into the toothing 39.

Then, the control equipment 87 indicates on the display 9 that the maximum number of dosing steps has taken place. Further, by the indication of a downward directed arrow it gives a sign that either liquid can be aspirated into the syringe 3 anew, or the residual liquid can be drained from the syringe 3 and the syringe 3 can be separated from the pipette 1. In case that further liquid is aspirated into the same syringe 3, the process is like that described above, wherein the control equipment 87 determines the sum of the dosing steps executed with the same set dosing volume, and indicates it on the display 9.

Any residual liquid in the syringe 3 can be discharged by relocating the draw-up lever 5 downward. The lower end position switch is actuated in doing so. Then, the control equipment 87 indicates a downward directed arrow on the display 9, as a sign that the syringe 3 can be separated from the pipette 1. In order to do this, the user actuates the gripping levers 23, 26.

When the draw-up lever 5 is dislocated, the cover stripe 45 is guided through the channel 50. The slit 4 remains always covered. The friction between cover stripe 45 and connection element is acting against any unintended relocation of the fixture body 25, as well as against that of the connection element with the draw up lever 5.

The process mentioned above is illustrated in FIG. 17. In the boxes of the flow chart, the associated indication in the display is given, and with explanations. A set dosing volume of 500 ml is indicated in the example.

Figure 17:
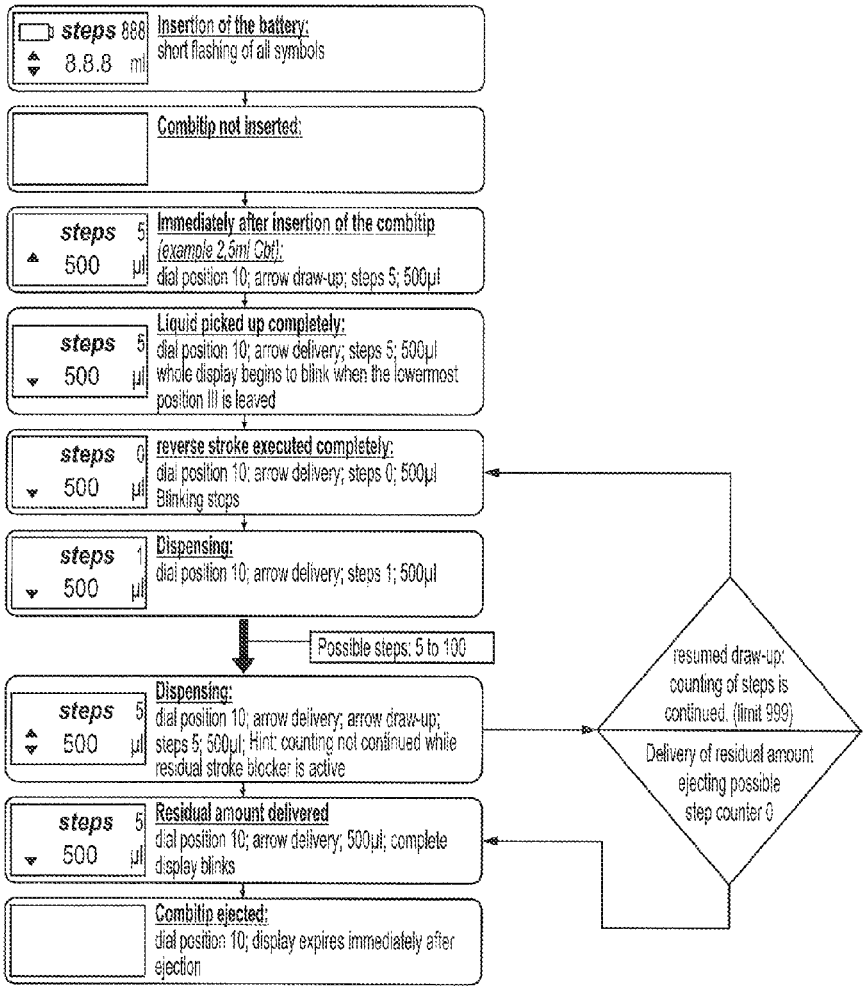
FIG. 17 method for dosing upon complete filling of the syringe, and indication of the set dosing volume and of the dosing steps in a flow chart.
Figure 18:
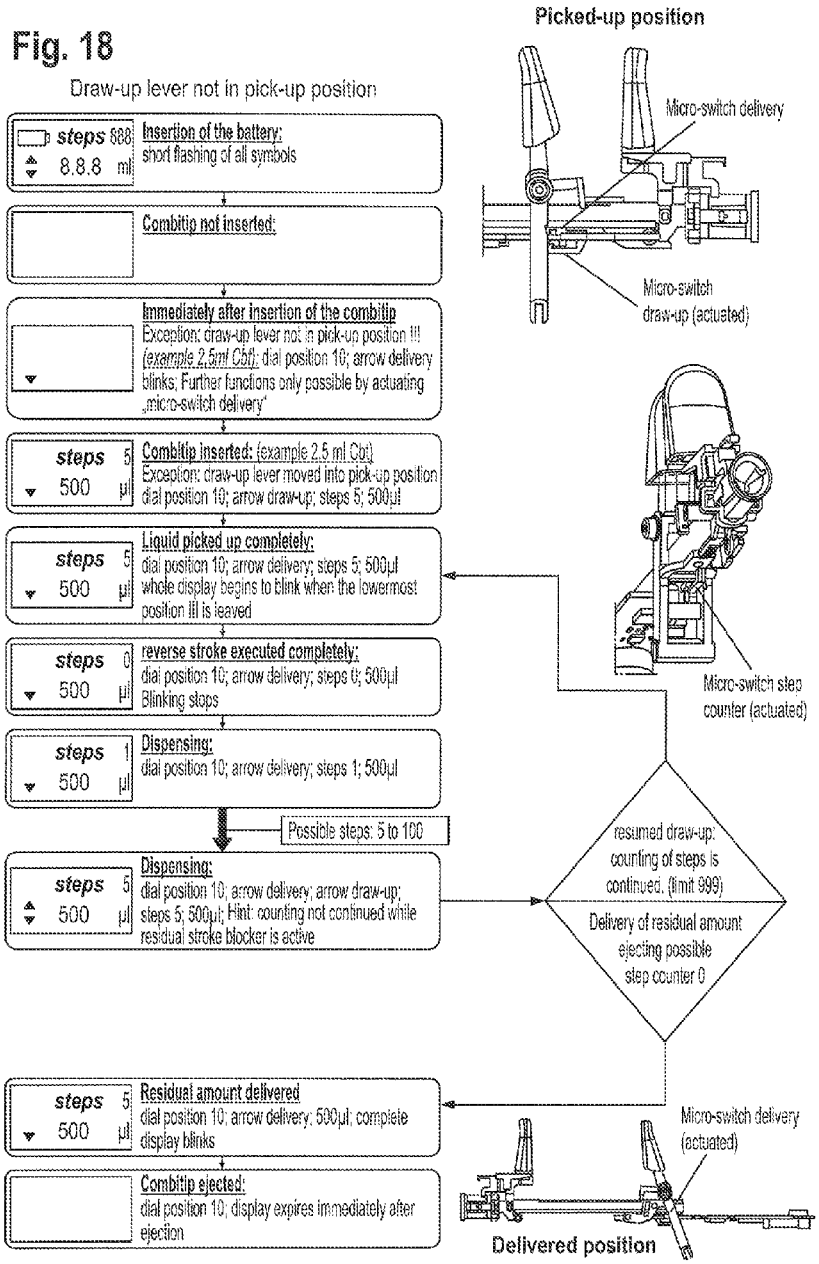
FIG. 18 method for dosing with fixture body initially not thrust back into the lower end position in a flow chart.

The process of FIG. 18 differs from the process of FIG. 17 in that the draw-up lever 5 is not in the lower end position when the pipette 1 is detachably connected to the syringe 3. The control equipment 87 can notice this in that the ring sensor 22 reports the insertion of a syringe 3, and the lower end position switch 81 reports that the fixture body 25 is not in the lowermost end position. In this position, the indication on the indicating equipment 9 gives a sign by a downward directed arrow to relocate the draw-up lever 5 downward. Only when this has happened, the set dosing volume, the maximum number of dosing steps and the upward directed arrow are indicated as a hint that the syringe 3 should be refilled. The further process corresponds to that of FIG. 17.

Figure 19:
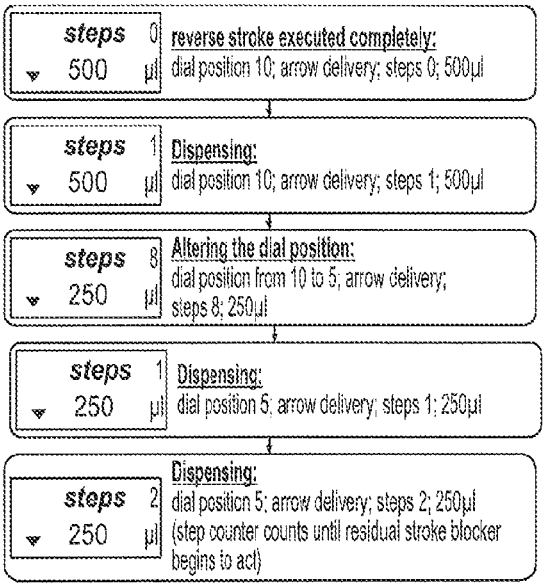
FIG. 19 part of a method for dosing upon change of the dosing step size in a flow chart.

The process of FIG. 19 differs from the process of FIG. 17 in that the setting of the dosing volume is changed in the dispensing. For instance, the dosing volume is altered to 250 ml after a dosing step with a dosing volume of 500 ml. The newly set dosing volume is then indicated by means of the indicating equipment 9, and also the maximum number of possible further dosing steps with this dosing volume and the liquid still remaining in the syringe 3. In the example, these are 8 further steps. Further, the dosing steps which were executed with the newly set dosing volume are counted and indicated.

Figure 20:
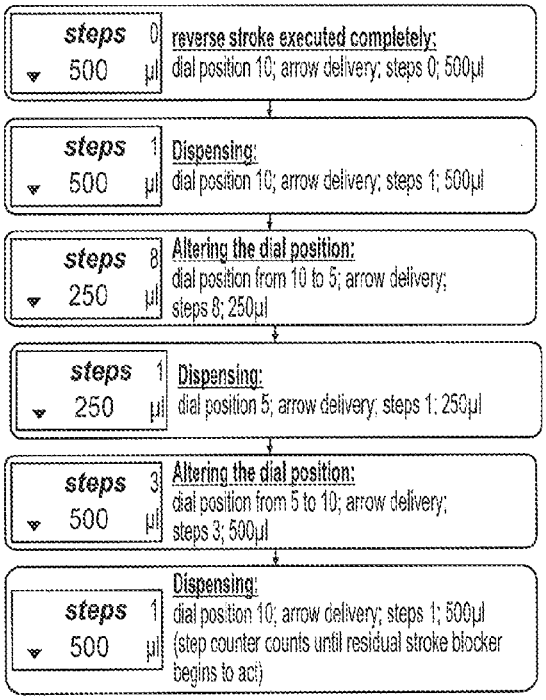
FIG. 20 part of a method for dosing upon change of the dosing step size and subsequent resetting of the dosing step size to the initial value in a flow chart.

The process of FIG. 20 differs from the process of FIG. 19 in that the dosing volume is reset to the initial value after the change of the dosing volume. In the example, the dosing volume is changed to a dosing volume of 250 ml after a dosing step of 500 ml. After one dosing step with a dosing volume of 250 ml, the dosing volume is reset to the initial dosing volume of 500 ml. Thereafter, the maximum number of possible further dosing steps with the initial dosing volume and the liquid still remaining in the syringe is indicated. In the dispensing, the dosing steps executed with this dosing amount after the resetting of the dosing amount to the initial value are counted and indicated. In a possible alternative, after the resetting of the dosing amount to the initially set value, the overall executed dosing steps with this dosing amount before and after the resetting, are counted and indicated in the dispensing.

The process of FIG. 21 differs from the process of FIG. 17 in that the syringe 3 is only partially filled. This is detected by the control equipment 87 on the basis of the signals of the lower end position switch 81 and the upper end position switch 67. Namely, when the lower end position switch 81 reports that the fixture body 15 has leaved the lower end position, and thereafter the dosing step counter reports the execution of a dosing step without that the upper end position switch 67 reports the arrival in the upper end position, the syringe has been filled only partially. The control equipment 87 emits then a blinking indication via the display 9. The blinking display further indicates the set dosing volume, the maximum possible number of dosing steps and the upward directed arrow. By the blinking of the display, it is indicated to the user that there is a partial filling, so that achieving the maximum number of dosing steps is not ensured.

The control equipment 87 stops the blinking of the indication only then when the user has executed a sufficient number of dosing steps which correspond to a reverse stroke. Through this, it is indicated to the user that no accurate dosing has taken place, and he/she should throw the delivered dosing amounts away. As soon as the reverse stroke has been done, the control equipment 87 outputs via the indicating equipment 9 the set dosing volume, the number of executed dosing steps and an arrow advising the downward relocation of the fixture body 25.

For each set dosing volume, the control equipment 87 looks up the number of necessary dosing steps for realising a reverse stroke in a memorized table. An example for such a table is given in FIG. 22.

The above processes of FIGS. 17 to 21 can be performed notably by means of the pipette according to FIGS. 1 to 16. The processes of FIGS. 1 to 17 can also be performed by means of other suitable pipettes.

LIST OF REFERENCE SIGNS

1 pipette
2 housing
3 syringe
4 slit
5 draw-up lever
6 slit
7 slit
8 actuation button
9 display
10 dial
11 cylinder

12 piston
13 portion
14 hole
15 portion
16 fastening portion
17 flange
18 piston rod
19 fastening portion
20 fixture
21.1 opening
21.2 opening
22 ring sensor
23 gripping lever
24 fixture
25 fixture body
26 gripping lever
27 tooth bar
28 draw-up lever mount
29 draw-up lever carrier
30 sliding board
31 post
32 hinge bearing
33 bulge
34 dosing lever
35 leg
36 leg
37 pawl
38 pawl tooth
39 toothing
40 covering
41 circuit board
42 accumulator
43 sensor
44 diaphragm
45 cover stripe
46 eye
47 eye
48 pin
49 pin
50 channel
51 lateral surface
52 lateral surface
53 side wall
54 side wall
55 cross member
56 breakthrough
57 projection
58 projection
59 pocket
60 pocket
61 wall
62 connection element
63 wing
64 wing
65 groove
66 groove
67 upper end position switch
68 touch lever
69 transmission element
70 transmission portion
71 lower end of transmission element
72 lower stop
73 control arm
74 control arm
75 upper end of control arm
76 upper end of control arm
77 stop edge
78 stop edge
79 switch arm
80 upper end of switch arm
81 lower end position switch
82 touch lever
83 upper stop
84 dosing step sensor
85 pin
86 dosing lever base
87 control equipment The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A pipette for handling a syringe, with a bar-shaped housing (2), a fixture (20) with an opening (21.1) at the lower end of the housing (2) for putting in a syringe (3) with a fastening portion (16) on the upper edge of a cylinder (11), a fixture body (25) with a further fixture (24) and a further opening (21.2) on the lower end of the housing (2), for putting in a further fastening portion (19) of a piston (12) of the syringe (3), means for detachably holding (23, 26) the fastening portion (16) in the fixture (20) and the further fastening portion (19) in the further fixture (24), means for relocating (5, 8, 34, 37, 27) the fixture body (25) within the housing (2) in the longitudinal direction of the housing (2), which comprise a draw-up lever (5), activated from the outside of the housing (2) for picking up liquid into the syringe, an actuation button (8), activated from the outside of the housing (2) for stepwise discharging liquid from the syringe (3), an adjusting element (10), adjustable from the outside of the housing (2) for setting a dosing step size, means for detecting (43) the dosing step size set by means of the adjusting element (10), means for detecting (22) a syringe (3) that is detachably connected to the pipette (1), means for detecting (84) the execution of a dosing step by actuating the actuation button (8), an electronic control equipment (87), connected to the means for detecting (22, 43, 84) the dosing step size, the syringe and the execution of the dosing step, an electronic indicating equipment (9), connected to the electronic control equipment (87), wherein the control equipment (87) is configured such that upon syringe (3) inserted into the pipette (1), it determines the dosing volume based on the set dosing step size and the maximum possible number of dosing steps with the set dosing step size and completely filled syringe (3) without refilling the syringe (3), and indicates the dosing volume and maximum possible number of dosing steps by means of the indicating equipment, and determines the number of executed dosing steps and indicates the number of performed dosing steps and/or the number of still possible dosing steps without refilling the syringe by means of the indicating equipment (9).

2. The pipette according to claim 1, which comprises a sensor for detecting an encoding imposing the syringe volume on a syringe (3) that is detachably connected to the pipette (1).

3. A pipette according to claim 1, which comprises means for detecting (81) a relocation of the fixture body (25) into a lower end position (67) for detachably connecting the pipette (1) to a syringe (3), and means for detecting (67) a relocation of the fixture body (25) into an upper end position for completely filling a syringe (3), wherein these means for detecting are connected to the electronic control equipment (87).

4. A pipette according to claim 1, which comprises means for detecting (67) a reverse stroke, which detect the actuation of a transmission element (69) for triggering the reverse stroke and are connected to the electronic control equipment (87).

5. The pipette according to claim 4, wherein the transmission element (69) is coupled to the fixture body (25), so that it is taken along in the relocation of the fixture body (25) into the upper end position and is taken along in the opposite direction in the reverse stroke, and the means for detecting (67) the relocation of the fixture body (25) into the upper end position are the means for detecting (67) the reverse stroke at the same time.

6. A pipette for handling a syringe, with a bar-shaped housing (2), a fixture (20) with an opening (21.1) at the lower end of the housing (2) for putting in a syringe (3) with a fastening portion (16) on the upper edge of a cylinder (11), a fixture body (25) with a further fixture (24) and a further opening (21.2) on the lower end of the housing (2), for putting in a further fastening portion (19) of a piston (12) of the syringe (3), detachable holding device (23, 26) for holding the fastening portion (16) in the fixture (20) and the further fastening portion (19) in the further fixture (24), relocation device (5, 8, 34, 37, 27) for relocating the fixture body (25) within the housing (2) in the longitudinal direction of the housing (2), which comprise a draw-up lever (5), activated from the outside of the housing (2) for picking up liquid into the syringe, an actuation button (8), activated from the outside of the housing (2) for stepwise discharging liquid from the syringe (3), an adjusting element (10), adjustable from the outside of the housing (2) for setting a dosing step size, detection device (43) for detecting the dosing step size set by means of the adjusting element (10), syringe detector (22) for detecting a syringe (3) that is detachably connected to the pipette (1), dosing step detector for detecting (84) the execution of a dosing step by actuating the actuation button (8), an electronic control equipment (87), connected to the means for detecting (22, 43, 84) the dosing step size, the syringe and the execution of the dosing step, an electronic indicating equipment (9), connected to the electronic control equipment (87), wherein the control equipment (87) is configured such that upon syringe (3) inserted into the pipette (1), it determines the dosing volume based on the set dosing step size and the maximum possible number of dosing steps with the set dosing step size and completely filled syringe (3) without refilling the syringe (3), and indicates the dosing volume and maximum possible number of dosing steps by means of the indicating equipment, and determines the number of executed dosing steps and indicates the number of performed dosing steps and/or the number of still possible dosing steps without refilling the syringe by means of the indicating equipment (9).

7. The pipette according to claim 6, which comprises a sensor for detecting an encoding imposing the syringe volume on a syringe that is detachably connected to the pipette.

* * * * *